United States Patent [19]

Fortune

[11] 4,282,783

[45] Aug. 11, 1981

[54] HANDLES FOR PLIERS

[76] Inventor: William S. Fortune, 29866 Cuthbert St., Malibu, Calif. 90265

[21] Appl. No.: 120,403

[22] Filed: Feb. 11, 1980

[51] Int. Cl.[3] ..... B25B 7/02

[52] U.S. Cl. ..... 81/428 R

[58] Field of Search ..... 81/304, 305, 306, 311, 81/428, 427; 30/262, 341

[56] References Cited

U.S. PATENT DOCUMENTS

| | | | |
|---|---|---|---|
| 876,963 | 1/1908 | Hoak | 81/311 |
| 2,520,808 | 8/1950 | Miller | 30/341 |
| 4,073,059 | 2/1978 | Wallace et al. | 30/262 |
| 4,229,924 | 10/1980 | Teachout | 81/427 |

*Primary Examiner*—James L. Jones, Jr.

*Attorney, Agent, or Firm*—Daniel T. Anderson

[57] ABSTRACT

Plastic handles are provided for conventional metal pliers and the like. One of the handles has an outer portion which when put over one of the handles of the pliers has smooth consecutive indentations to fit the four fingers of the operator. The second handle has a smooth outwardly curved outer portion to fit the palm of the operator and an indentation close to the jaws of the pliers to fit the thumb of the operator. The handles consist of a moldable plastic material having electrical insulating properties and having a central opening thereto shaped to fit the plier handles. The insides of each of the handles facing each other when inserted over the plier handles have serrated portions to retain components and the like thereby to provide a holding fixture.

8 Claims, 6 Drawing Figures

Fig. 1.
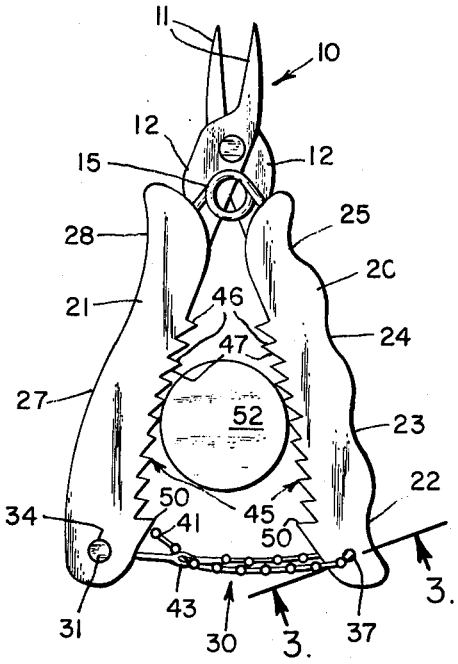
Fig. 2.
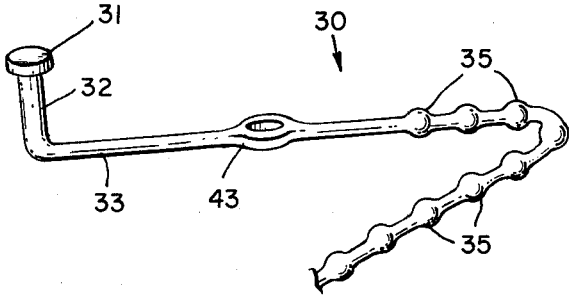
Fig. 3.
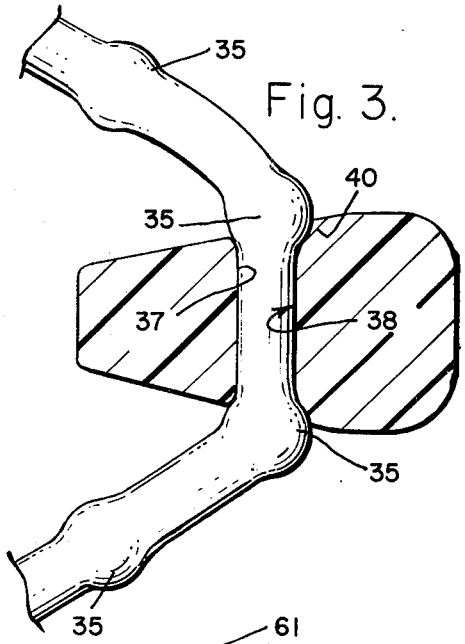
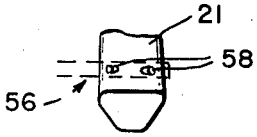
Fig. 5.
Fig. 4.
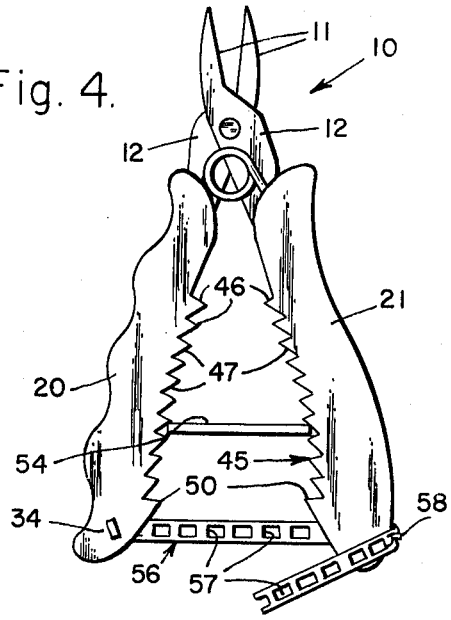
Fig. 6.
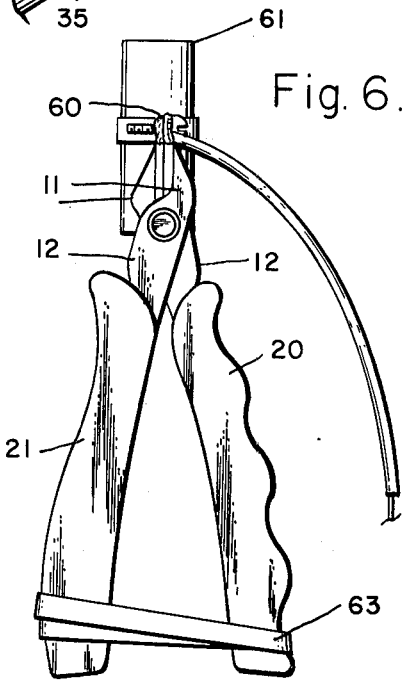

HANDLES FOR PLIERS

BACKGROUND OF THE INVENTION

Plastic handles for metal pliers and the like such as slim-nosed pliers, long-nosed pliers, angle cutters or shears and straight cutters or shears are well known. The term pliers when used herein is meant to include both pliers, as well as shears or cutters. It is also known to provide such relatively inexpensive pliers with plastic handles to facilitate operating them and to protect the fingers of the operator. However, these prior art handles have a substantially circular cross-section and are not particularly adapted for the shape of the human hand. Furthermore, such prior art pliers with handles have no provision for keeping the handles closed. If such pliers or particularly cutters are left open in a tool box they may easily injure an operator who reaches in the tool box to remove one of the tools therein.

It is accordingly an object of the present invention to provide handles for metal pliers which are specifically adapted to fit the shape of the human hand, thereby to facilitate the job of the operator.

Another object of the present invention is to provide such handles with a special strap having one end secured to one of the handles while the other end is free to pass through an opening in the other handle, thereby to be able to lock the pliers in any particular position.

Still another object of the present invention is to provide the handles with means for locking a component such as a cylindrical electrical component, a circuit board or the like, whereby the handles transform the pliers into a holding fixture.

SUMMARY OF THE INVENTION

In accordance with the present invention each of the two plastic handles for a pair of metal pliers is made to fit specifically the hand of a human operator. Thus one of the handles has an outer portion when inserted over one of the handles of the pliers which has smooth consecutive indentations to fit the four fingers of the operator.

The second handle has a smooth outwardly curved outer portion to fit the palm of the operator and an indentation close to the plier jaws to fit the thumb of the operator. Both handles consist of a moldable plastic material having electrical insulating properties. This will permit use of the pliers on electrical components or on circuit boards and the like without causing an electric shock to the operator. It will be understood that each of the handles has an opening therethrough which is shaped to fit the plier handles. Finally, the insides of the two handles facing each other have serrated portions to retain components and the like, thereby to provide a holding fixture.

BRIEF DESCRIPTION OF THE DRAWINGS

FIG. 1 is a plan view of a pair of pliers having the handles of the present invention;

FIG. 2 is an elevational view of a preferred strap for the handles having one end portion shaped to be retained by a suitable opening in one of the handles, the strap having beaded portions which are equally spaced from each other.

FIG. 3 is a cross-sectional view taken on line 3—3 of FIG. 1 through the end of one of the handles and showing an opening extending therethrough which will have a tight fit with the beads of the strap of FIG. 2;

FIG. 4 is an elevational view of a pair of pliers with the handles of the invention showing a different type of strap which might be called a ladder strap and a circuit board held by the serrations of the handles;

FIG. 5 is a detailed view to illustrate how the free end of the ladder strap is held by one of the handles; and FIG. 6 is a view similar to that of FIG. 4 but illustrating the plier jaws being closed by means of a rubber band to clamp the terminals of an electrical component.

DESCRIPTION OF THE PREFERRED EMBODIMENTS

Referring now to the drawings and particularly to FIGS. 1–3, there is illustrated, by way of example, a preferred embodiment of the present invention.

Referring now to FIG. 1, there is illustrated a conventional pair of pliers 10 having jaws 11 and handles 12. A spring 15 may be mounted between the two handles 12 to tend to maintain the jaws 11 in the open position. The pliers may consist of metal which may either be nickel plated or anodized to provide a black surface to avoid reflections. The pliers may be of any conventional type such as long-nosed or slim-nosed plier. The jaws of the pliers may be serrated or smooth as is conventional. Included in the term "plier" are cutters or shears which may either be straight or angle shears.

The present invention resides in a pair of handles 20 and 21 which have each a central opening to fit over the handles 12 of the metal pliers 10. The handle 20 is provided with four consecutive indentations 22, 23, 24 and 25. The indentations 22–25 are provided along the outer portion of the handles to fit the four fingers of the operator. Each of the handles 20 and 21 consist of a plastic modable material which preferably has electrical insulating properties. This makes it possible to utilize the pliers with the handles of the invention for electrical work.

The other handle 21 has a smooth outwardly curved outer portion 27 followed by an indentation 28 which is shaped to fit the thumb of the operator. This identation 28 is at the end of the handle toward the plier jaws 11.

Since the handles 20 and 21 are easily removable, they can be reversed for use by a left-handed operator. Furthermore, the handles may be color coded, each color to be used with a particular tool such as different colors for shears, angle shears and slim-nosed pliers. An important feature of the handles of the invention is that they may be provided with a strap 30 of the type shown in FIG. 2. The strap 30 has an enlarged cylindrical portion 31 followed by a straight, reduced diameter cylindrical portion 32 which extends at right angles as shown at 33. One of the handles, say handle 21, may have an aperture 34 through which the strap 30 can be pulled and so that the enlarged portion 31 will be flush with the surface of the handle 21.

The free portion of the strap 30 is provided with a plurality of beads 35 which are equally spaced from each other. They serve the purpose to be passed through an opening 37 through the other handle, say handle 20; the opening 37 has a central portion 38 (see FIG. 3) which is substantially straight and of such dimensions that the beads 35 can be forced through the central portion 38. The outer ends of the hole 37 may be outwardly flared as shown at 40.

It will now be apparent that the free end 41 of the strap 30 may be pulled through the hole 37 with some force and will stay in whatever position it has been previously put. The bead 30 is provided with a central hole 43 therein. The free end 41 of the strap 30 may be pulled through the opening 43 in the strap 30, thereby to hold the free end of the strap.

It is preferred that the strap 30 be used to keep the pliers or shears in a closed position when not in use. This will prevent injury to an operator, particularly when he has to search for one of many tools in his tool box. Also, it will be obvious that when the pliers are in the closed position they take up less space.

Each of the two handles 20 and 21 is provided with serrations 45 which face each other as shown in FIG. 1. Each of the serrations 45 has a substantially straight edge 46 which is substantially normal to the longitudinal direction of its handle. In addition, each serration has an inclined edge 47 which is inclined toward the rear end of each of the handles. The last indentation 50 toward the rear end of the handle is larger than the others, but has the same general shape. Its purpose is to prevent a cylindrical object from slipping out between the handles. Thus, it forms a backstop for the handles. This is shown in FIG. 1 where a cylindrical component 52 is shown clamped between the serrations 45. As indicated, if the object is fairly large it will finally be stopped by the last serration 50.

Such a component can now be locked in place by simply tightening the strap 30, that is by pulling it through the opening 37. The free end of the strap 30 may be pulled through the opening or eye 43.

It should be noted that the shape of the handles 20 and 21 is such that they can be held solely between the thumb and the index finger of the operator without loosening the operators's grip.

Referring now to FIG. 4, there is shown another application for the handles of the invention, as well as a different type of strap. As shown in FIG. 4, a circuit board 54 is provided with substantially square or rectangular openings 57 spaced equal distances from each other. As shown in FIG. 5, one of the handles such as handle 20, is provided with rounded projections 58 through which the openings 57 of the strap 56 fit. This will hold the strap at any desired position, thereby to lock the pliers or rather the circuit board 54. The openings 57 may then be used for securing the free end of the strap 56 by pulling the strap through one of the openings.

It should be noted that either the beaded strap 30 or the ladder strap 56 may be made of a plastic material having spring like properties. Thus, the strap 56 preferably is an elastomer. Such a strap will tend to push the two handles 20 and 21 apart. In this case, of course, the metal spring 15 may be dispensed with. Such a material may, for example, consist of nylon.

FIG. 6 illustrates another application of the handles of the invention. Thus, it is feasible to keep the plier jaws 11 closed upon a terminal 60 of an electrical component 61. In this case, it is feasible, for example, to keep the plier jaws 11 closed by a rubber band 63. In such a case, the plier jaws 11 may function as a heat sink to keep a particular portion of the component at a low temperature. It may also be used as an electrical contact for monitoring a particular solder point or the like. In this case, the jaws 11 of the pliers 10 may be connected to a suitable volt meter or ampere meter.

It will be realized that the metal pliers to which the handles of the invention are applied are relatively inexpensive. They are what is called the bottom of the line. However, by the use of the handles of the invention such low priced components may be upgraded and converted into higher-priced tools.

In some cases it may be desirable to utilize a soft moldable plastic for the strap 30 such as urethane. In this case, the beads 35 may be so adjusted with respect to the hole 37 that the jaws 11 of the pliers are only partly open. Thus, the strap 30 is pulled through the hole 37 to obtain the desired partial opening. In this manner, the operator does not have to fully close the pliers for his work because they are only partly open.

There has thus been disclosed a pair of handles to be applied to standard pliers. The handles have a shape to fit the fingers and hand of an operator. They are also supplied with internal serrations facing each other for gripping a particular component such as an electrical component or a circuit board, thereby to provide a holding fixture. By means of a special strap the pliers may be maintained in a closed position or a semi-closed position to lock a component to the serrations. While each of the handles is made to fit either the fingers or the thumb of an operator, the handles may be reversed to fit the hand of a left-handed person.

What is claimed is:

1. Handles for metal pliers comprising:

(a) a first handle having an outer portion which when put over one of the handles of the pliers has smooth consecutive identations to fit the four fingers of the operator;

(b) a second handle having a smooth outwardly curved outer portion to fit the palm and an indentation close to the jaws of the pliers to fit the thumb of the operator, both of said handles consisting of a moldable, plastic material having electrical insulating properties and having a central opening therethrough shaped to fit over the plier handles;

(c) the insides of each of said handles facing each other when inserted over the plier handles having serrated portions to retain components and the like, thereby to act as holding fixture;

(d) a safety strap;

(e) retaining means on one end of said strap;

(f) a hole in one end of one of said handles for passing therethrough said safety strap and retaining means;

(g) a hole in the other one of said handles for passing therethrough the free end of said strap; and (h) means for retaining the loose end of said strap, said means being disposed near the fixed end of said strap.

2. Handles as defined in claim 1, wherein said strap consists of a plastic material.

3. Handles as defined in claim 2, wherein said plastic material has spring-like properties to act as a spring when installed tending to spread the jaws of the pliers apart.

4. Handles as defined in claim 1, wherein said strap includes beads spaced equal distances from each other, said beads having a tight fit in the hole through the other one of said handles, but to permit to pull the strap therethrough, said means for retaining said strap including a hole disposed in said strap near the fixed end thereof to retain the loose end of said strap.

5. Handles as defined in claim 4, wherein said hole in the other one of said handles consists of a narrow straight central portion and outwardly flared portions.

6. Handles as defined in claim 1, wherein said strap consists of a plastic band having substantially equally spaced substantially rectangular openings therein.

7. Handles for metal pliers comprising:

(a) a first handle having an outer portion which when put over one of the handles of the pliers has smooth consecutive indentations to fit the four fingers of the operator;

(b) a second handle having a smooth outwardly curved outer portion to fit the thumb of the operator, both of said handles consisting of a moldable, plastic material having a central opening therethrough shaped to fit over the plier handles; and (c) a safety strap having retaining means on one end, a hole in one end of one of said handles for passing therethrough said safety strap and retaining means, a hole in the other one of said handles for passing therethrough the free end of said strap, and means for retaining the loose end of said strap, whereby the jaws of the pliers may be locked in any desired position.

8. A pair of pliers and handle covers therefor comprising:

(a) a pair of jaws for the pliers;

(b) a pair of handles for operating said jaws;

(c) a first handle cover having an outer portion which when put over one of the handles of the pliers has smooth consecutive indentations to fit the four fingers of the operator;

(d) a second handle cover having a smooth outwardly curved outer portion to fit the thumb of the operator, both of said handle covers consisting of a moldable plastic material having a central opening therethrough shaped to fit over one of said plier handles; and (e) a safety strap having spring-like properties and retaining means on one end, a hole in the other end of one of said handle covers for passing therethrough said safety strap and retaining means, a hole in the other one of said handle covers for passing therethrough the free end of said strap, and means for retaining the loose end of said strap, whereby the jaws of the pliers may be locked in any desired position.

* * * * *